US007207610B1

(12) United States Patent
Kauppila

(10) Patent No.: US 7,207,610 B1
(45) Date of Patent: Apr. 24, 2007

(54) CLAM FOR WOOD HANDLING EQUIPMENT

(76) Inventor: Richard W. Kauppila, 158 S. Basin Dr., Negaunee, MI (US) 49866

( * ) Notice: Subject to any disclaimer, the term of this patent is extended or adjusted under 35 U.S.C. 154(b) by 265 days.

(21) Appl. No.: 10/792,670

(22) Filed: Mar. 3, 2004

Related U.S. Application Data

(60) Provisional application No. 60/451,526, filed on Mar. 3, 2003.

(51) Int. Cl.
*B66C 1/42* (2006.01)

(52) U.S. Cl. ..... 294/88; 294/106; 294/86.41

(58) Field of Classification Search ..... 294/88, 294/106, 68.23, 86.41; 37/461, 186, 187
See application file for complete search history.

(56) References Cited

U.S. PATENT DOCUMENTS 3,384,409 A * 5/1968 Guinot ..... 294/88
3,759,564 A * 9/1973 Seaberg ..... 294/88
3,902,614 A * 9/1975 Roberts et al. ..... 414/735
4,005,895 A * 2/1977 Cullings ..... 294/65.5
4,042,272 A * 8/1977 Gotzen ..... 294/88
4,178,030 A * 12/1979 Dolinsek ..... 294/68.23
4,907,356 A * 3/1990 Labounty ..... 37/406
5,024,397 A * 6/1991 Edwards et al. ..... 294/68.23
5,330,242 A * 7/1994 Lucky, Sr. ..... 294/88
5,620,222 A * 4/1997 Prinz ..... 294/88

* cited by examiner

*Primary Examiner*—Dean J. Kramer
(74) *Attorney, Agent, or Firm*—John R. Benefiel

(57) ABSTRACT

A wood handling clam having a pair of hollow curved jaws constructed of side walls and inside and outside covers welded thereto. A hollow carrier housing on which the jaws are pivoted at their upper ends has a downwardly extending center portion received into a slot formed into the upper end of each jaw. A tubular pivot pin extends through each upper end of each of the jaws and a pair of carrier housing side plates, as well as the through the down central portion of the carrier housing. Tubular cross shafts in the jaws and housing anchor devises for mounting each end of a power cylinder for each jaw extending into the slot in the upper end of each jaw.

11 Claims, 7 Drawing Sheets

CLAM FOR WOOD HANDLING EQUIPMENT

CROSS REFERENCE TO RELATED APPLICATION

This application claims the benefit of U.S. provisional Ser. No. 60/451,526, filed Mar. 3, 2003.

BACKGROUND OF THE INVENTION

This invention concerns wood handling equipment and more particularly large clams for moving logs or stacks of cord wood. Such clams typically include pivoted pairs of jaws constructed of heavy steel plates hinged on solid pins supported on a rotary housing.

The great weights involved have led to frequent failure of these components.

It is the object of the present invention to provide a heavy duty clam suitable for wood handling which is of greater strength than prior designs without being itself excessively heavy.

SUMMARY OF THE INVENTION

The above object and other objects which will become apparent upon a reading of the following specification and claims are achieved by a clam in which each curved jaw is of a hollow construction having inner and outer covers welded onto side walls comprised of plates cut in the shape of the jaw, creating a unitary structure.

Each jaw also has two lengthwise extending interior partition plates shaped similarly to the side plates and which extend along an upper slot space defined at the center of each jaw which receives a hydraulic cylinder used for opening and closing each jaw.

A carrier housing, also of hollow construction includes a downwardly projecting center portion received into the slot of each jaw, and has a clevis on each side providing a pivotal connection to the upper end of a respective power cylinder.

Aligned pairs of segment gears are welded to the upper outside of a side plate defining in part each jaw, with a tubular pivot pin for each jaw passed through each pair of segment gears into bores in carrier housing side plates, which pin also passes through and is supported by the center section of the carrier housing to support each pin at either end and at its middle.

A replaceable hardened steel wear plate is affixed to the lower end of each jaw.

DETAILED DESCRIPTION

Figure 1:
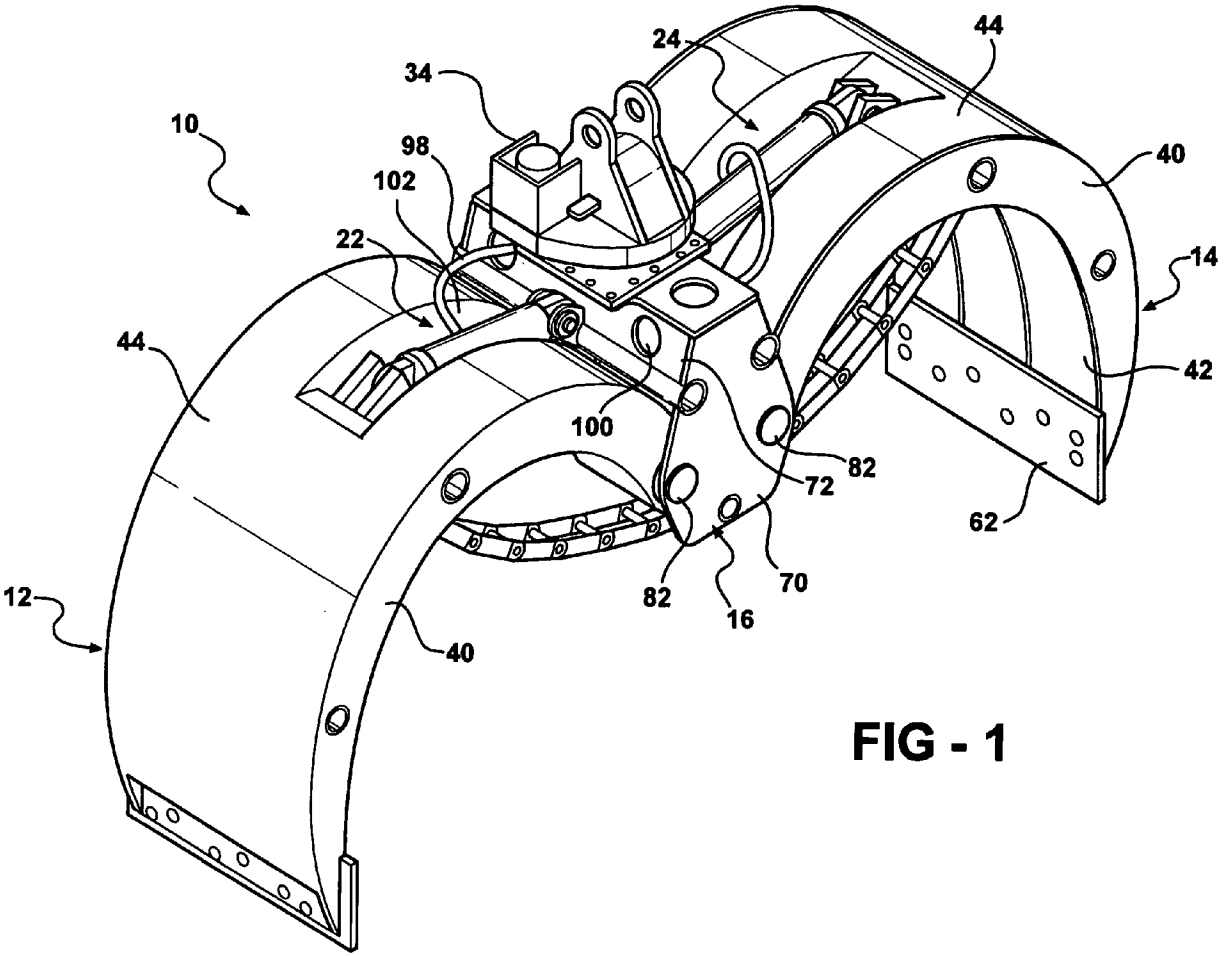
FIG. 1 is a pictorial view of a clam according to the present invention in the open position.
Figure 2:
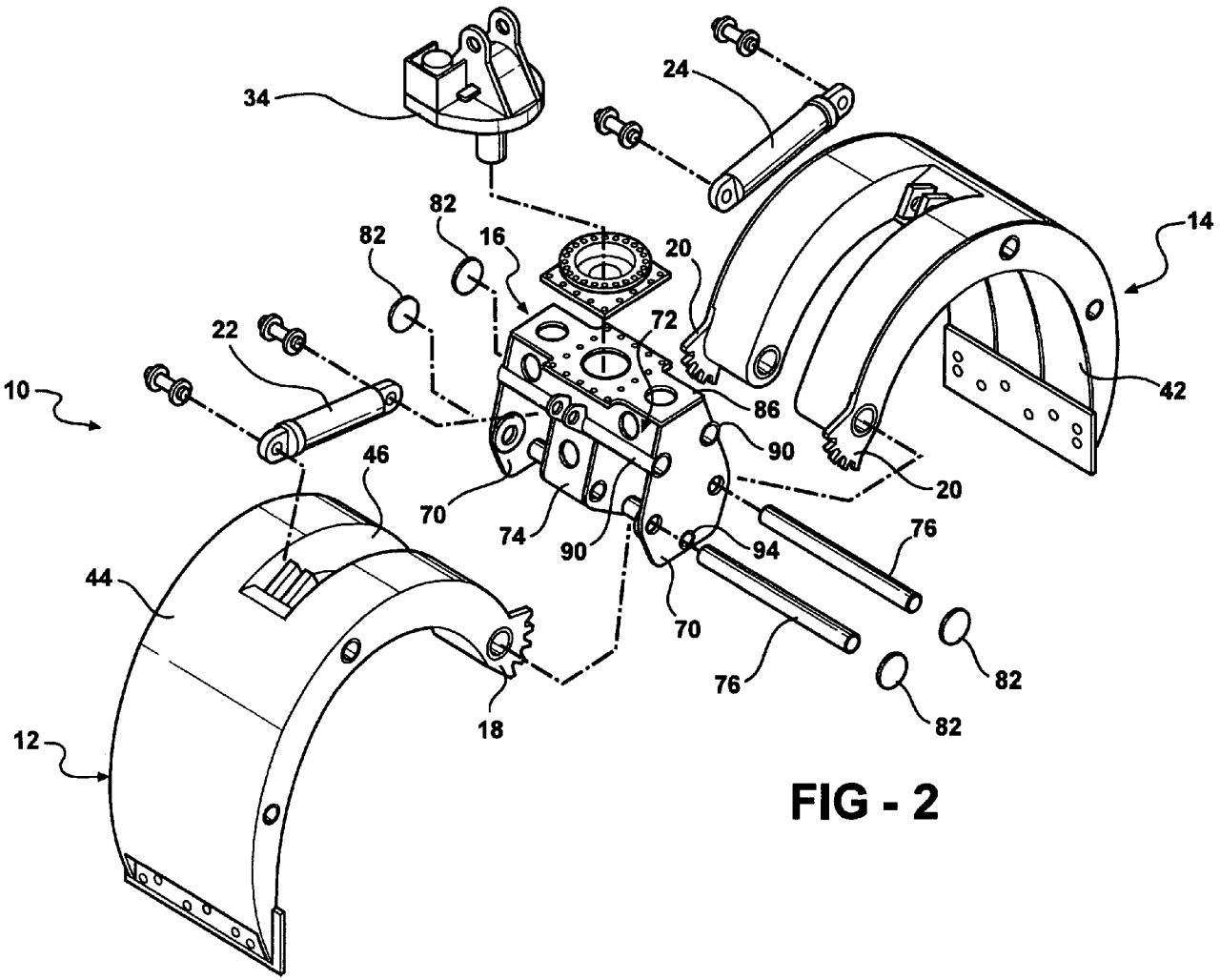
FIG. 2 is an exploded pictorial view of certain of the components of clam shown in FIG. 1.
Figure 4:
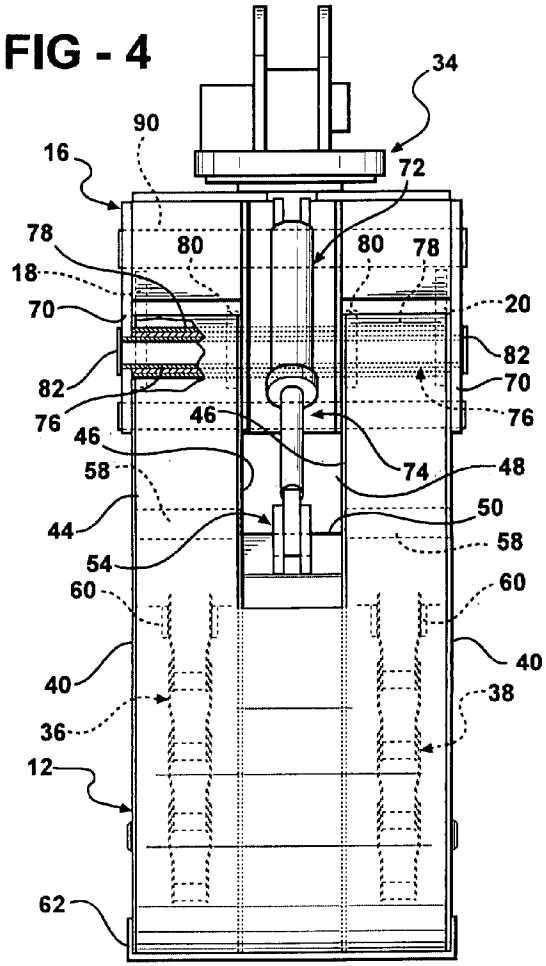
FIG. 4 is a side view of the closed clam shown in FIG. 3.
Figure 3:
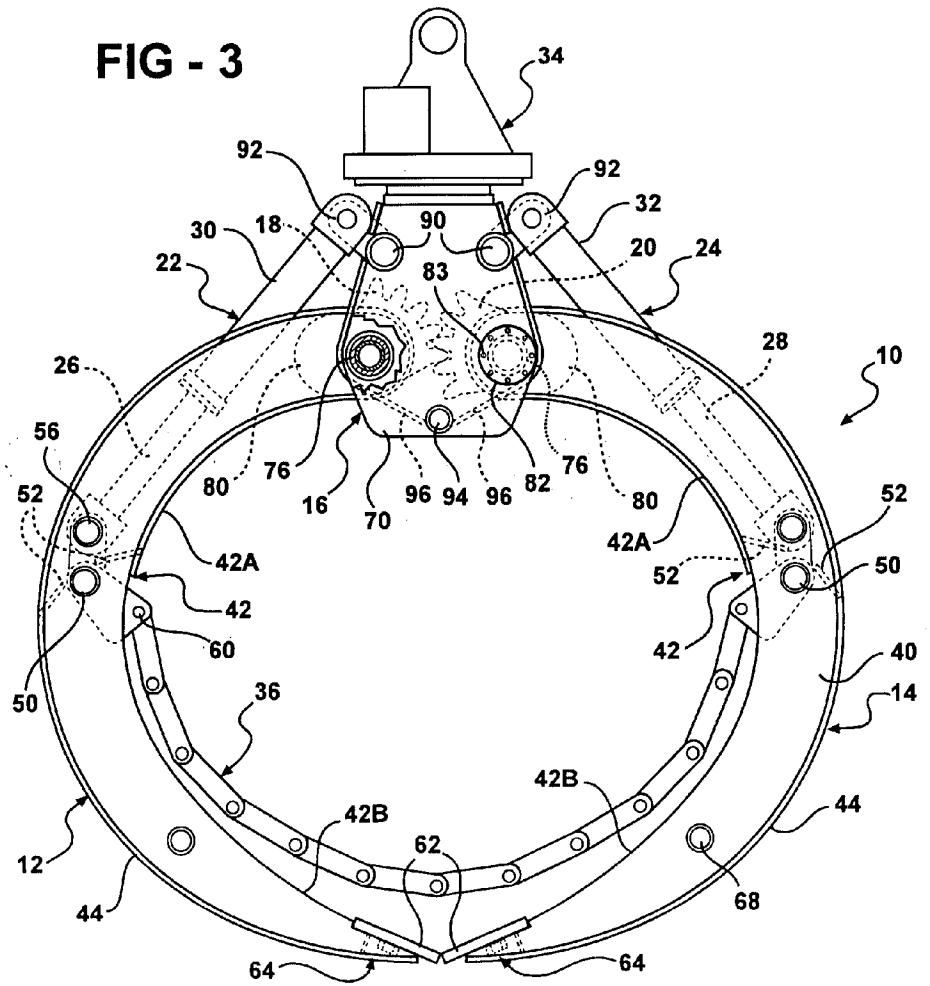
FIG. 3 is a front view of the clam shown in FIG. 1 in the closed position.
Figure 5:
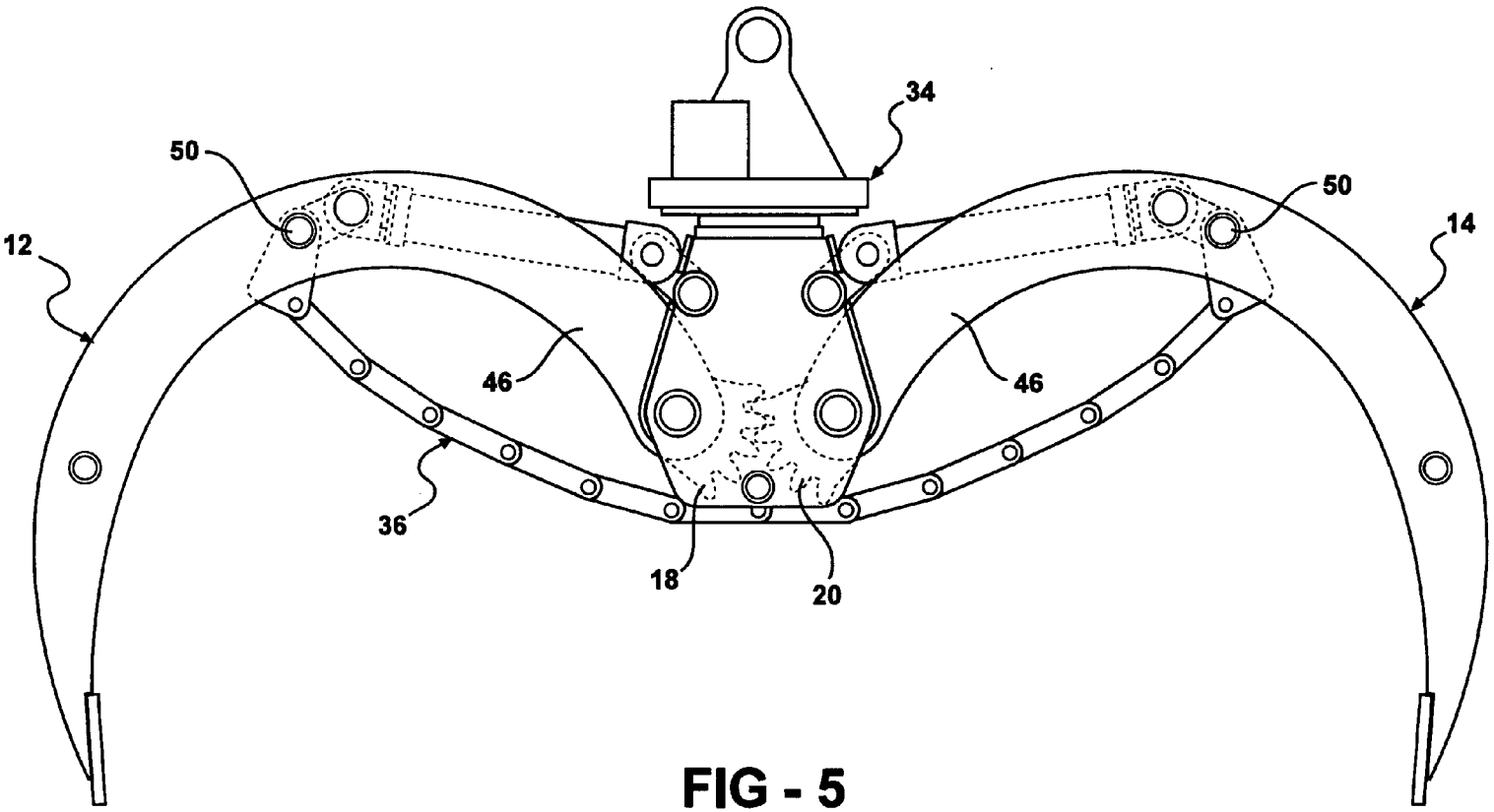
FIG. 5 is a front view of the clam shown in FIG. 1 in the open position.
Figure 6:
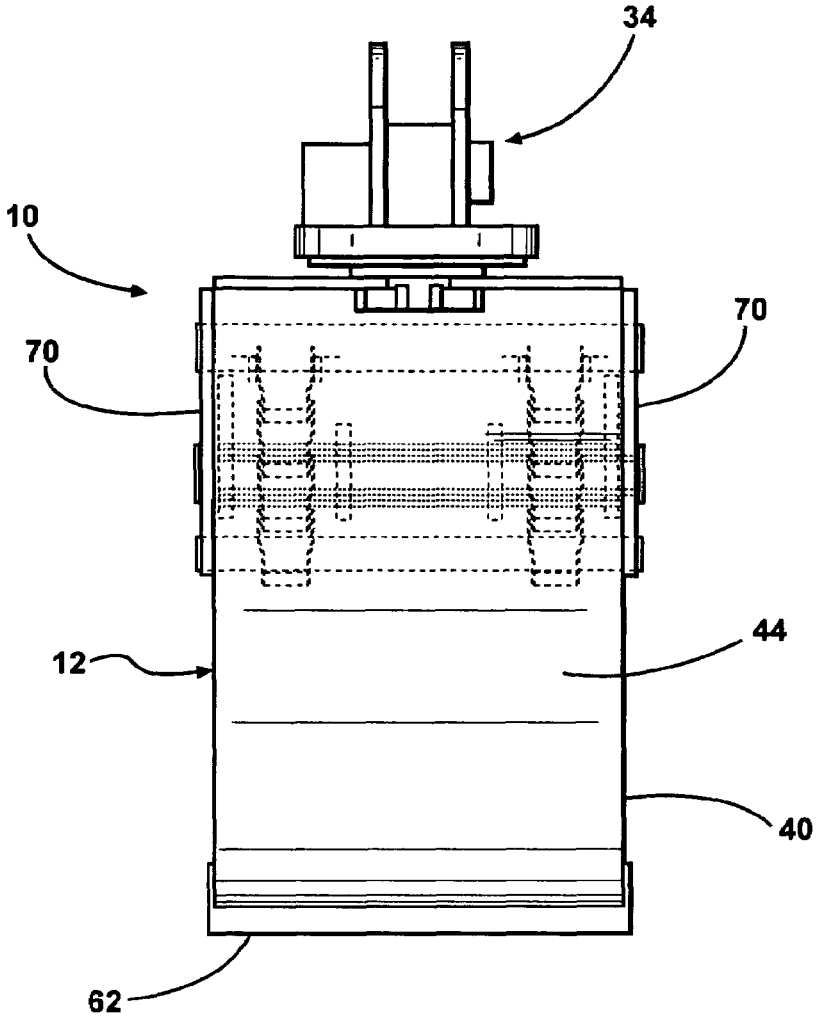
FIG. 6 is a side view of the clam in the open position.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, and particularly FIGS. 1–5, the clam 10 has a pair of opposed curving jaws 12, 14, each pivoted at its upper end to a carrier housing 16. A pair of sector gears 18, 20 are fixed to each jaw upper end, each gear in mesh with a gear on the other jaw to insure equalized pivoting movement of the jaws 12, 14 in the well known manner.

A power cylinder 22, 24 is associated with each jaw 12, 14, to enable opening and closing having an actuator rod 26, 28 pivoted to a respective jaw 12, 14 and a cylinder body 30, 32 pivoted to the carrier housing 16.

The carrier housing 16 is mounted below a hydraulic swivel motor 34 allowing the jaws 12, 14 to be pivoted about a vertical axis. The motor 34 is mounted to conventional wood handling equipment (not shown) enabling transport of the clam 10 and its load.

A pair of heavy chains 36, 38 are each connected at either end to the inside of the jaws 12, 14 at an intermediate point along the length.

The chains 36, 38 are drawn up as the jaws open (FIG. 5), and draped over the load (not shown) as the jaws 12, 14 close, tending to grip the logs or cordage stack to retain the same.

The above arrangement is broadly known in the prior art, and the present invention concerns an improved construction of the jaws 12, 14 and carrier housing 16.

The jaws 12, 14 have a hollow construction, in which pairs of curved side walls comprised of plates 40 are welded to curved inside and outside covers 42, 44 to form a hollow structure.

A pair of lengthwise extending stiffening partition plates 46 similar in shape to that of the side walls 40 are also welded in place spaced apart from each other and the side plates 40. The covers 42, 44 are cut out in their upper reaches to form a slot 48 bounded by the insides of exposed partition plates 46. The cylinders 22, 24 extend within a respective slot 48.

A steel cross tube 50 extends across each jaw 12, 14 at the base of the slot 48, with closure pieces 52 welded thereto and to the inside of the covers 42, 44.

A pivot clevis 54 is welded to the cross tube 50 in the region of the slot 46 to which the cylinder rod 26, 28 is secured with a pin 56. Access tubes 58 may be provided to allow installation and removal of the pins 56.

Chain devises 60 are also welded to the steel cross tube 50 to provide a connection to the end of each chain 36, 38.

The inside covers 42 are constructed in two sections 42A, 42B, with the lower section 42A recessed within the side walls 40, to expose the edges of the side walls 40 as shown for better gripping of the load.

Figure 8:
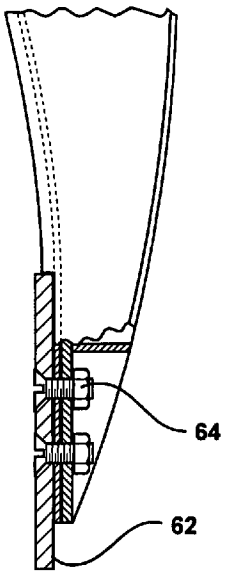
FIG. 8 is a front view of the jaw portion shown in FIG. 7.

A wear resistant lip plate 62 is affixed to the inside of the tips of each jaw 12, 14, attached by screw and nut sets 64 to be readily replaceable (FIG. 8).

Figure 7:
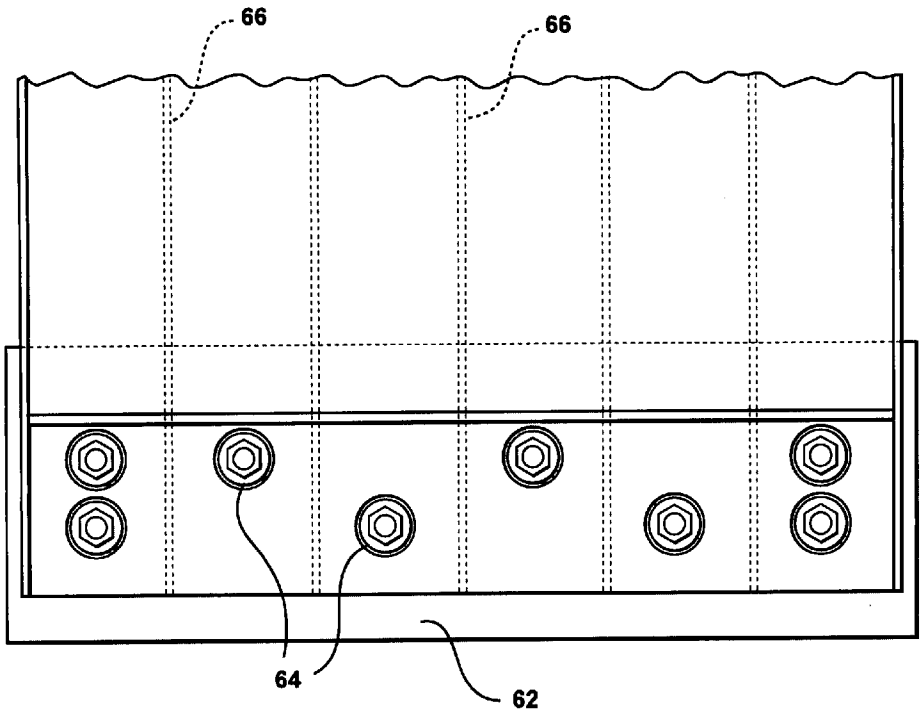
FIG. 7 is a fragmentary side view of the lip end of one of the jaws included in the clam according to the invention.

Additional partition stiffeners 66 can also be welded to the covers 42, 44 in the region of the jaw tip (FIG. 7) and to a steel cross tube 68 passing therethrough.

Figure 9:
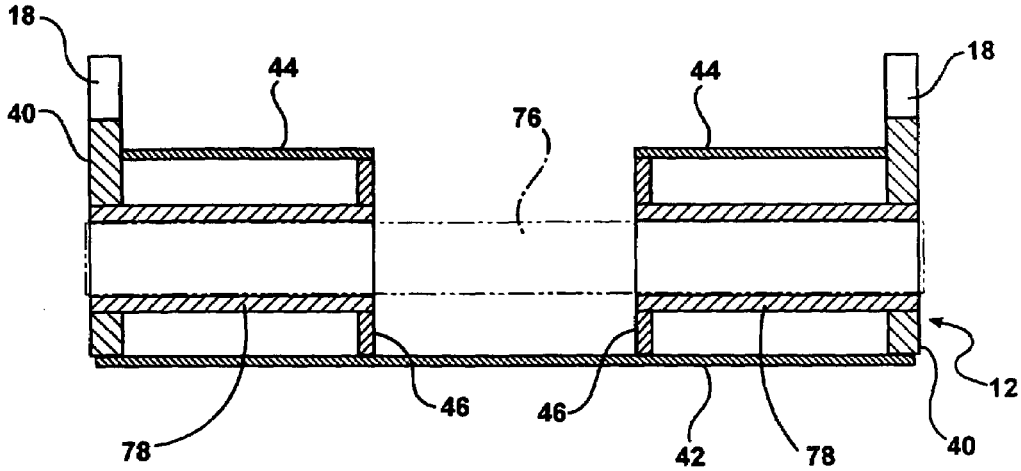
FIG. 9 is a view of a section taken through the upper end of one of the jaws.
Figure 10:
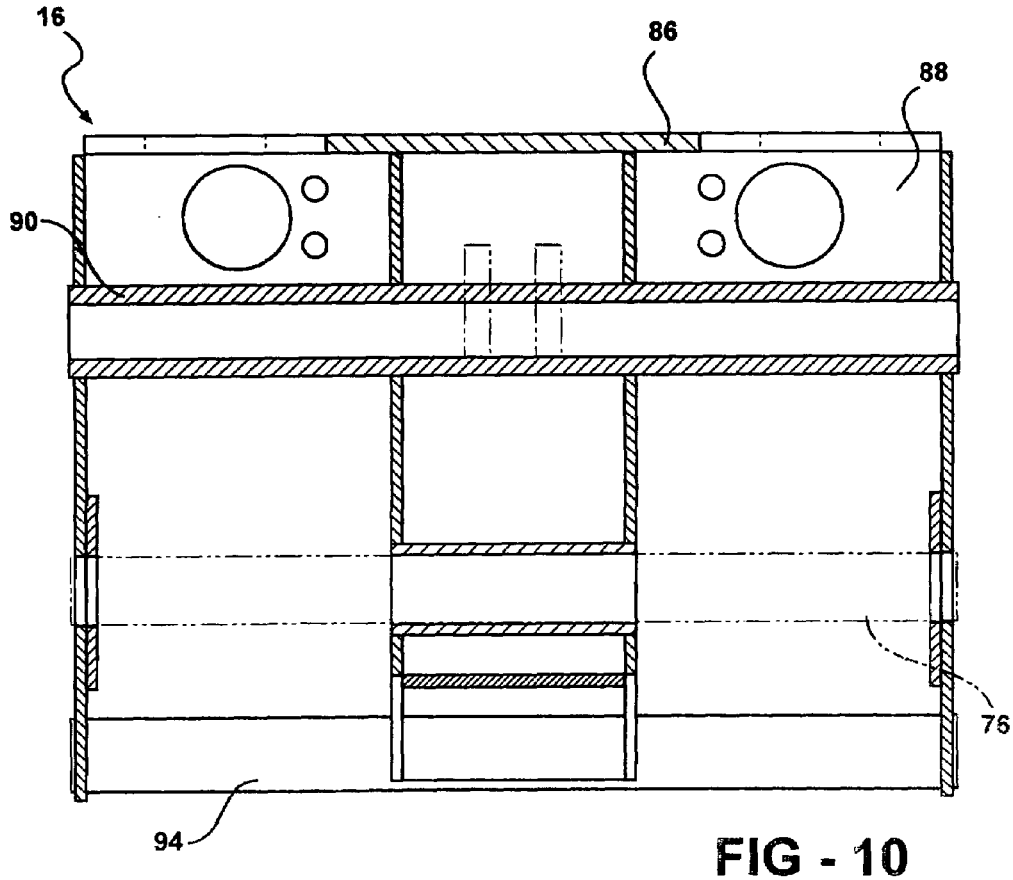
FIG. 10 is a view of a section taken through the carrier housing in the region receiving the pivot pin of one of the jaws.

The carrier housing 16 is constructed with a pair of side plates 70 extending down from the upper carrier portion 12 over the outside of upper ends of the jaws 12, 14. An intermediate housing portion 74 extends down from the upper portion 72 into the upper region of slot 46 to provide a center support for a pair of tubular jaw pivot pins 76, which also pass through housing side plates 70 to be supported at either end and at its middle. The pins 76 also pass through bushings 78 in each portion of the jaws on either side of the slot 46 (FIG. 9).

Reinforcing plates 80 are also provided at the jaw ends.

The pins 76 are held in place by covers 82 affixed thereto at either end and secured with fasteners 83 (FIG. 3) to the plates 70.

A top plate 86 and side plates 88 form the hollow upper carrier housing portion, with a pair of steel cross tubes 90 welded thereto adding to the rigidity thereof. Upper cylinder devises 92 are welded to the cross tubes 90 for pin mounting of the cylinder housings 30. External hydraulic hose connections 98 are provided attached over holes 100 in the plate 88 to connect with hydraulic supply from the swivel motor 34 (not shown). This simplifies replacement of the hoses 102.

The intermediate housing portion 74 also has a tube 94 welded at the bottom, with bottom cover plates 96 closing off the bottom thereof.

The boxed hollow structure and improved support of the tubular jaw pivot pins 76 provides a much stronger yet relatively light weight structure.

The invention claimed is:

1. A wood handling clam comprising:

a swivel motor;

a carrier housing mounted on said swivel motor;

a pair of opposed curved jaws pivoted at an upper end to said carrier housing;

a pair of power cylinders, each pivoted at one end to said carrier housing and at another end to a respective clam jaw;

the improvement comprising each of said jaws being of hollow construction, defined by a pair of side walls and an inside and outside cover affixed to said side walls;

each of said jaws having a slot extending in from said upper end thereof in which a respective power cylinder extends; and each jaw having a pair of partition plates shaped as said side walls and aligned therewith, spaced apart and from said side walls, said partition plates welded to said inside and outside covers and each pair of partition plates having upper ends extending alongside said slot in said jaw.

2. The clam according to claim 1 wherein said carrier housing is also of a hollow construction.

3. The clam according to claim 2 wherein said carrier housing includes a downwardly extending central portion received into each of said slots of said jaws.

4. The clam according to claim 3 wherein each of said jaws is mounted by a tubular pin extending through said upper end of each of said jaws and passing through said central portion of said carrier housing.

5. The clam according to claim 4 wherein said carrier housing further includes a pair of side plates spaced laterally from said central portion extending down alongside the same, each jaw pivot pin received in an opening in each side plate, each of said jaws upper end positioned in a space between a respective side plate and a respective side of said central portion.

6. The clam according to claim 5 wherein said carrier housing includes a pair of upper cross tubes, extending between said side walls and affixed thereto at either end.

7. The clam according to claim 6 wherein each of said carrier housing upper cross tubes has a clevis affixed thereto for pivotal mounting one end of each power cylinder.

8. The clam according to claim 6 wherein said carrier housing has a lower cross tube extending between said side plates and affixed at either end to a respective side plate.

9. The clam according to claim 1 wherein each of said jaws further including a first cross tube extending between said side walls and affixed thereto at a respective end thereof.

10. The clam according to claim 9 wherein a respective cylinder mounting clevis is affixed to said first jaw cross tube.

11. The clam according to claim 1 wherein a part of said inner cover of each jaw is recessed from said side walls to expose an inside edge on each of said side walls for better load gripping.

* * * * *